US006021994A

United States Patent [19]

Shartzer, Jr.

[11] Patent Number: 6,021,994

[45] Date of Patent: Feb. 8, 2000

[54] FLEXIBLE CONCRETE FORM

[76] Inventor: Michael E. Shartzer, Jr., 5363 Buena Vista, Roeland Park, Kans. 66205

[21] Appl. No.: 08/924,378

[22] Filed: Sep. 5, 1997

[51] Int. Cl.[7] ..... E01C 7/00

[52] U.S. Cl. ..... 249/6; 249/2; 249/3; 249/7; 249/189

[58] Field of Search ..... 249/2, 3, 4, 5, 249/6, 7, 189, DIG. 3; 52/85, 245; 404/96, 98

[56] References Cited

U.S. PATENT DOCUMENTS

| | | | |
|---|---|---|---|
| 2,661,516 | 12/1953 | Yates | 249/6 |
| 2,663,925 | 12/1953 | Yates | 249/6 |
| 2,731,700 | 1/1956 | Yates | 249/7 |
| 2,745,165 | 5/1956 | Lewis | 249/3 |
| 2,793,416 | 5/1957 | Yearling | 249/7 |
| 2,795,836 | 6/1957 | Nagin | 249/3 |
| 2,887,556 | 5/1959 | Brechel | 249/6 |
| 3,788,020 | 1/1974 | Gregori | 52/309 |
| 4,229,920 | 10/1980 | Lount | 52/309 |
| 4,579,312 | 4/1986 | White | 249/6 |
| 4,595,168 | 6/1986 | Goodwin | 249/48 |
| 4,712,764 | 12/1987 | White | 249/6 |
| 4,776,555 | 10/1988 | Maynard | 249/6 |
| 4,824,068 | 4/1989 | Ferland | 249/6 X |
| 5,154,837 | 10/1992 | Jones | 249/2 |
| 5,399,050 | 3/1995 | Jacobus | 405/229 |
| 5,464,680 | 11/1995 | Hauser et al. | 428/141 |

*Primary Examiner*—David Bagnell
*Assistant Examiner*—Jong-Suk Lee
*Attorney, Agent, or Firm*—Shook, Hardy & Bacon LLP

[57] ABSTRACT

A flexible concrete form which can be arranged to provide both straight and curved configurations, and is adapted to flex both horizontally and vertically. The form includes a face panel and upper and lower flanges having lips on their back edges. An intermediate rib spaced below the upper flange provides a ledge on which a rigid core member can be installed to enhance the rigidity for straight areas. The upper and lower flanges have aligned openings for receiving stakes used to anchor the form to the ground. The form is preferably constructed from polyethylene, polyvinyl chloride, or polybutylene because of the strength and flexibility of these materials as well as their ability to release from concrete without the need for scraping or release agents.

15 Claims, 3 Drawing Sheets

FLEXIBLE CONCRETE FORM

FIELD OF THE INVENTION

This invention relates generally to forms of the type used in the pouring of concrete and similar moldable materials and deals more particularly with a form which is flexible in order to permit both straight and curved shapes to be constructed.

BACKGROUND OF THE INVENTION

Concrete forms of various types have long been widely used in construction work. When the structure that is to be built has straight sides, the forms are usually constructed from rigid steel or wood. If curved shapes are required, other materials are normally used, including flexible metal, masonite, lap siding, and strips of thin plywood which can be bent into the desired shape. If a structure has a straight portion that connects with a curved area, different types of forms must be used for the different sections, and there can be problems in the transition area where they meet. When different materials are used for the forms in the straight and curved areas, the transition area is often difficult to set or finish properly.

All of the materials that are commonly used for concrete forms are easily damaged. If steel forms are dented or bent, they are essentially useless. Wood forms are difficult if not impossible to use over and over again. Moreover, wood is a precious resource, and thus undesirable for use as a disposable form material. Also, concrete can stick to the forming faces of wood, steel and other materials to the point where adequate cleaning is impossible. Release from the concrete once it has set usually requires the use of a release agent or labor-intensive scraping which complicates the construction process and add to the costs. Handling of many types of forms is difficult because of their weight and bulk.

U.S. Pat. Nos. 4,579,312 and 4,712,764 to White disclose flexible forms in which rubber is the preferred material. Although the patents disclose use of these forms to provide curved shapes, the forms are lacking in strength and rigidity and are not well suited for straight shapes. Additionally, these forms are designed for flexure of a horizontal nature, but are prohibited from flexure of a vertical nature by their very construction. They are also characterized by complicated anchoring systems. U.S. Pat. No. 5,154,837 to Jones discloses another flexible form. It includes a core which is flexible enough to allow bending but rigid enough to prevent the outer steel structure from kinking. Again, the necessary strength and rigidity is lacking to permit this type of form to be successfully used for the construction of long, straight runs. These forms are also cost-prohibitive to manufacture.

SUMMARY OF THE INVENTION

The present invention is directed to a concrete form which is uniquely constructed to exhibit the desirable properties of both rigid and flexible forms without being prone to the problems that are associated with both types of forms. In addition, the form of the present invention is compatible for use with existing types of forms and is not susceptible to being damaged irreparably as is the case with steel and wood forms.

In accordance with the invention, a flexible form is constructed from polyethylene, polyvinyl chloride, or polybutylene, each of which naturally releases easily from poured concrete. The form has a face panel which contacts the concrete and top and bottom flanges which add strength and rigidity. The form can be provided in different sizes, lengths and shapes. An open channel is presented on the back side of the face panel between the flanges. The bottom of the channel can be formed by a rib which projects from the back side of the face panel and which adds rigidity as well as a ledge for receiving a rigid core member such as a length of lumber. Installation of the lumber is done from the back of the form, and need not be slid into place along the axis of the form as in prior designs.

Although the form exhibits the required rigidity due to the presence of the flanges, the rib, and lips which are turned from the back edges of the flanges, the relatively flexible material of which the form is constructed accommodates bending it into virtually any desired curved shape. Additionally, the form is flexible both in a horizontal and a vertical direction. Thus, the form is particularly useful where poured concrete is to have a radius, and is to be located on a variable gradient. When straight sections of concrete are to be constructed, a rigid core member such as a length of lumber can be inserted into the channel to provide more than adequate strength and rigidity and prevent the form from being deformed by the force of the poured concrete. Straight sections can be joined end to end with curved sections, so the form is useful with other identical forms to produce virtually any shape, including smooth transition areas between straight and curved areas.

The flanges of the form can be provided with aligned openings for receiving stakes that are driven into the ground to anchor the form in place. The openings are spaced apart so that a standard length core can be installed between them without interfering with the anchoring system. As an alternative to installing the stakes in the flange openings, the stakes can be positioned against the lip on the top flange, driven into the ground, and secured to the form by driving nails or other fasteners connected with the stakes into the core which is inserted in the channel.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 2:
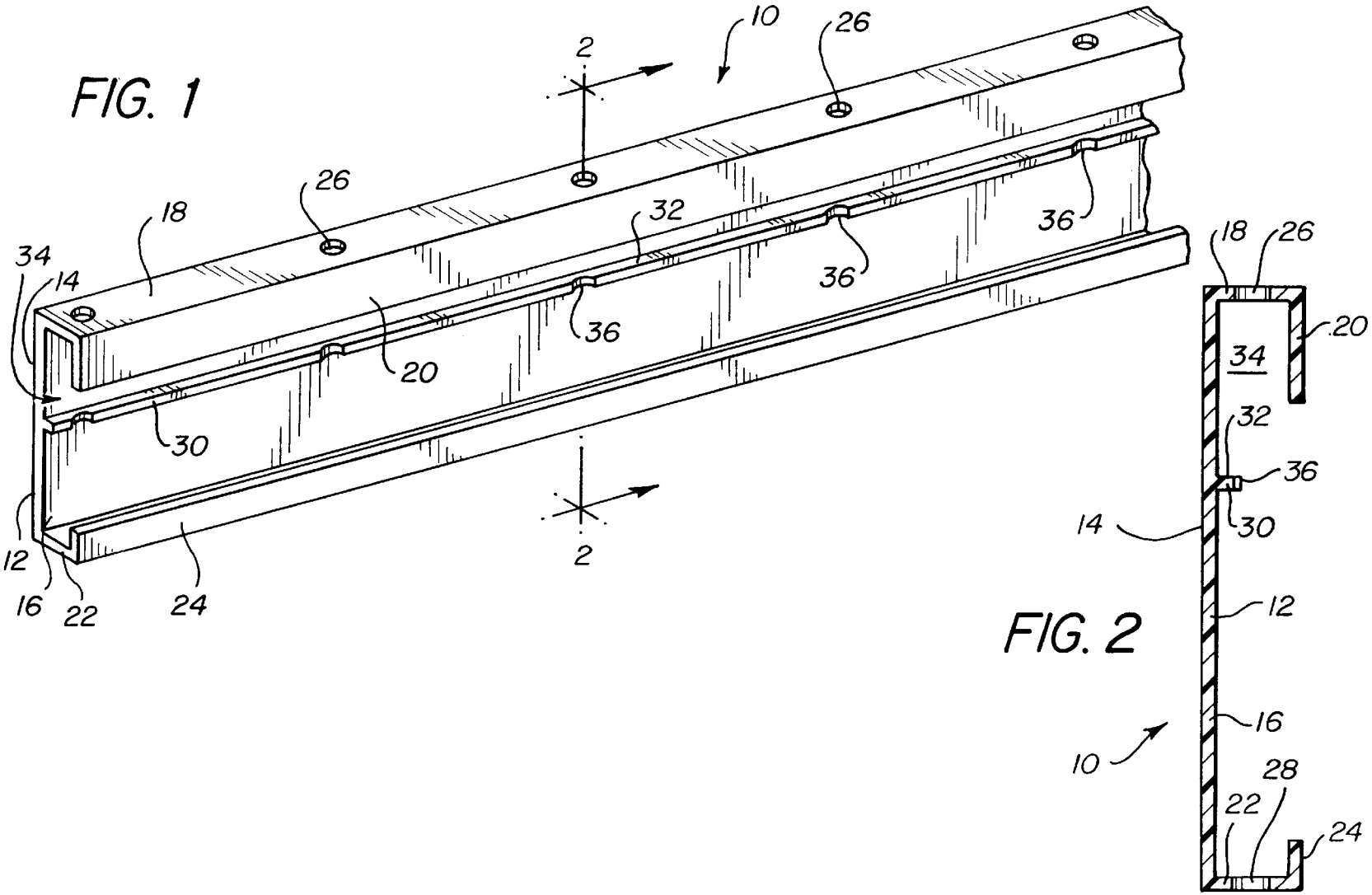
FIG. 1 is a fragmentary perspective view of a concrete form constructed according to a preferred embodiment of the present invention.
FIG. 2 is a sectional view through the form taken generally along line 2—2 of FIG. 1 in the direction of the arrows.

Referring now to the drawings in more detail and initially to FIG. 1, numeral 10 generally designates a construction form which is used in the shaping of structures constructed of poured concrete and other moldable construction materials. The form 10 is preferably constructed in a single integral piece by an extrusion process of the type commonly employed in connection with plastic materials. Preferably, form 10 is constructed from polyethylene, polyvinyl chloride, or polybutylene. Similar materials exhibiting strength and flexibility comparable to polyethylene, polyvinyl chloride, and polybutylene may be used in some applications. However, either polyethylene, polyvinyl chloride, or polybutylene is preferred because these materials have the requisite strength and flexibility and also release naturally from poured concrete without the need for scraping or treatment of the form surfaces with release agents and the like.

The form 10 has the general shape of the letter C in section and includes a flat face panel 12. The face panel 12 extends vertically when the form is in use and is relatively thin. The height of the face panel 12 can vary depending upon the desired height of the structure which is being built. The face panel 12 has a planar front face 14 against which the poured concrete bears. The face 14 is smooth in order to provide a smooth finish on the concrete structure.

The face panel 12 has a rear face 16. Extending rearwardly from the upper edge of the face panel 12 is an upper flange 18. A downwardly extending lip 20 is formed on the back edge of the flange 18. Lip 20 extends below flange 18 and is substantially parallel to the face panel 12. A lower flange 22 extends rearwardly from the bottom edge of the face panel 12. A relatively short lip 24 extends upwardly from the back edge of flange 22. Lip 24 is parallel with the face panel 12 and is located in the same plane as the upper lip 20.

The top flange 18 is provided with a plurality of round openings 26 which are spaced uniformly along the length of the form 10. A plurality of round openings 28 are also formed in the lower flange 22. The lower openings 28 are aligned directly below the corresponding upper openings 26 and are similarly spaced apart along the length of the form.

The rear face 16 of the face panel 12 is provided with a rearwardly projecting rib 30 which is located longitudinally along the face panel 12. Rib 30 extends continuously along the length of the form 10 and presents an upwardly facing shoulder 32 that forms a ledge defining the bottom of a rectangular channel 34. The top of the channel is defined by the bottom surface of the upper flange 18. The front of the channel is formed by the top portion of the rear face 16 of the face panel 12. The back of the channel 34 is formed by the front surface of the upper lip 20. The channel 34 is open in the area between the bottom edge of lip 20 and the back edge of rib 30. In an alternate embodiment, with reference to FIG. 3, one or more additional ribs 31,33 extends continuously along the length of the form at spaced locations beneath rib 30, thereby forming a plurality of additional channels.

The back edge of rib 30 can be provided with a plurality of arcuate notches 36. The notches 36 are aligned with corresponding pairs of upper and lower openings 26 and 28, as shown in FIG. 1.

Figure 3:
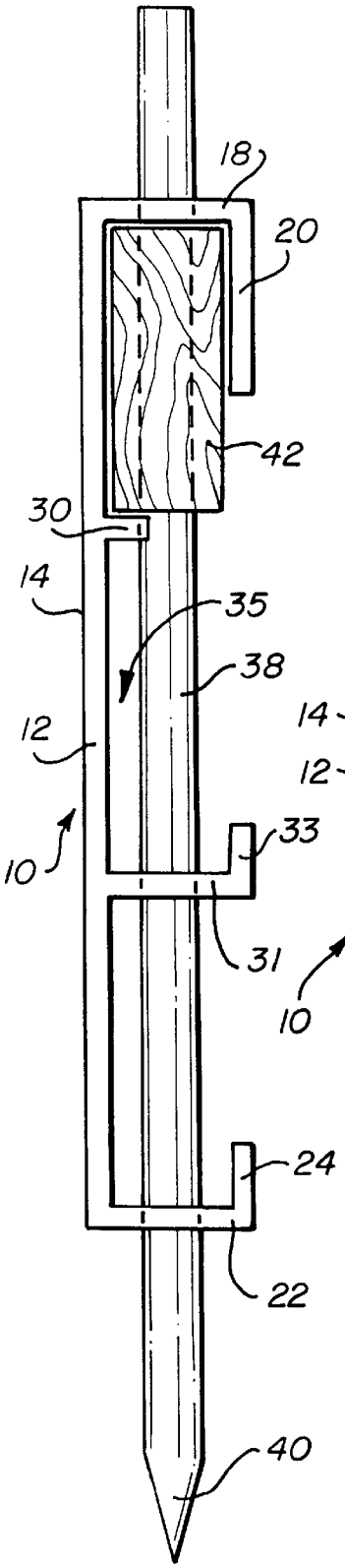
FIG. 3 is an end elevational view of the form shown in FIG. 1, with a length of lumber installed in the channel of the form and a stake extended through openings in the flanges of the form to anchor it in place.
Figure 7:
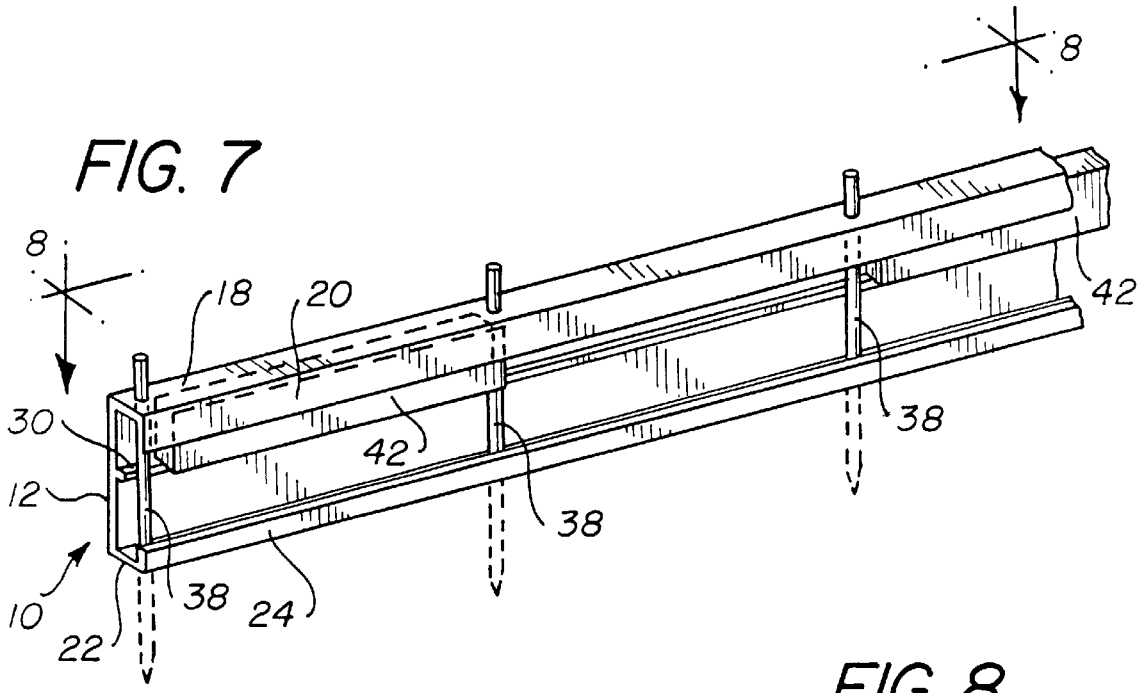
FIG. 7 is a fragmentary perspective view showing the form of FIG. 1 anchored to the ground by a series of stakes extended through the flange openings, with core members installed in the channel of the form between some of the adjacent stakes.

With reference to FIGS. 3 and 7 in particular, the form 10 can be anchored to the ground at the proper position by a plurality of stakes 38. Each stake 38 has a cylindrical shank and a sharp tip 40 on its lower end. The diameter of each stake may be slightly less than the diameter of each of the openings 26 and 28. The length of the stakes 38 can vary as desired, although the stakes should have a length that significantly exceeds the distance between the flanges 18 and 22. When the stakes are used to anchor the form, they are extended through the openings 26 and 28 and through the notches 36 and are driven into the ground.

In order to add strength and rigidity to the form 10, one or more core members 42 may be installed in the channel 34. Each core member 42 may have a rectangular shape in section and a size slightly less than the channel 34. As shown in FIG. 7, each core member 42 may have a length less than the distance between the adjacent sets of openings 26 and 28 in order to avoid interfering with the anchoring system provided by the stakes 38. When installed in the channel 34, each core member 42 rests on the ledge presented by the shoulder 32 of rib 30. Preferably, core members 42 may be lengths of standard two by four lumber. Preferably, the adjacent stake openings are spaced apart a distance slightly greater than the length of a standard wall stud. This avoids a need to cut the core members 42. However, the core members can be virtually any desired length. In an embodiment including multiple ribs, additional core members can be inserted in each channel to further increase rigidity.

In accordance with the principles of the invention, insertion of the core member into channel 34 is extremely easy and efficient. The core member is inserted into channel 34 from behind form 10. The flexible nature of lip 20 permits it to be flexed outwardly during insertion of the core member into channel 34.

Figure 8:
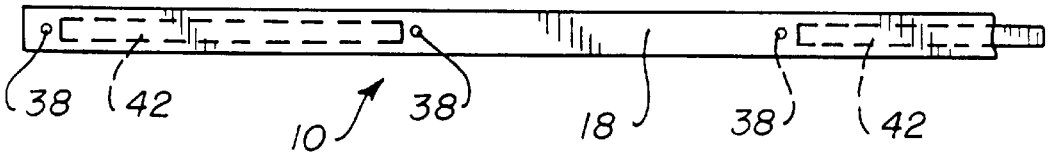
FIG. 8 is a fragmentary top plan view taken generally along line 8—8 of FIG. 7 in the direction of the arrows.

With continued reference to FIG. 7 in particular, the form may be used by placing the lower flange 22 on the ground and then driving the stakes through the openings 26 and 28 and through notches 36 into the ground. When the form is maintained in a straight condition to construct a straight section of the poured concrete structure, one of the core members 42 can be inserted in the channel 34 between each adjacent pair of the stakes 38. However, the core member, if long enough, may pass by multiple pairs of stake openings and still maintain the rigidity of the form 10. Alternatively, the core members 42 can be absent altogether or can be installed in only some sections of the channel 34, with other parts of the channel remaining vacant. FIGS. 7 and 8 show a core member 42 installed in the channel 34 between every other pair of stakes, but this is only one possible arrangement. If a pair of the forms 10 are arranged end to end, one of the core members 42 can be installed to span the two forms and extend partially within the channel 34 of one of the forms and partially within the channel of the other form. The ability to insert the core members without having to slide them into place longitudinally makes many variations, and subsequent alterations, extremely easy to accommodate.

Figure 9:
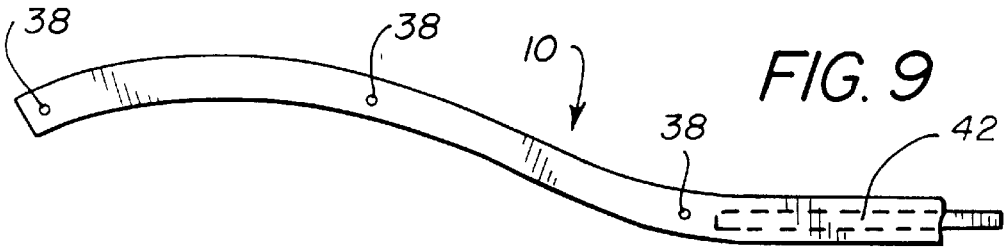
FIG. 9 is a top plan view similar to FIG. 8 but showing the form flexed into a curved shape.

FIG. 9 shows a form which is flexed into a curved shape in order to form curves in the concrete structure. The flexibility of the material of which the form is constructed readily accommodates flexure into curved shapes. The rigid core members 42 are not installed in areas of the form that are curved. Whether the core member 42 is present or not, stakes 38 which are extended through the openings 26 and 28 are also received closely in the notches 36 of rib 30 to stabilize the anchoring of the form and provide additional stability for the rib 30. It will be understood that notches 36 are optional, and that the flexible nature of rib 30 permits it to bend as necessary at the location of a stake 38 in the absence of a notch 36.

Figure 10:
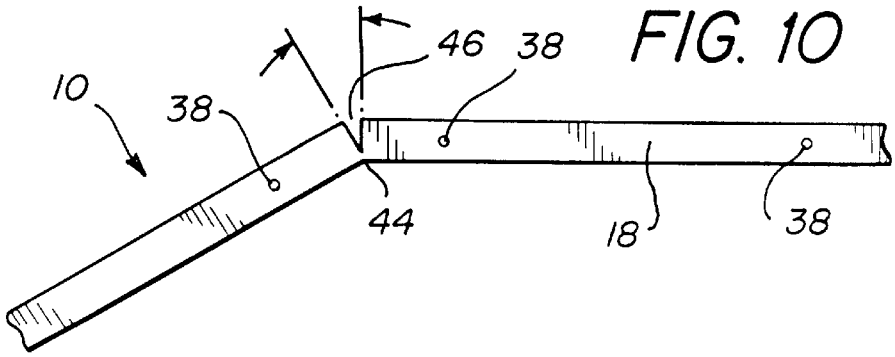
FIG. 10 is a top plan view similar to FIG. 8, but showing the flanges cut and the form bent adjacent to the cuts to present an angularly bent configuration.

FIG. 10 shows form 10 set up to provide an angular bend 44 with straight sections of the form presented on opposite sides of the bend. The bend 44 is created by cutting through the flanges 18 and 22 and the lips 20 and 24 at a location adjacent to the bend 44, as indicated by the cut 46 in FIG. 10. The face panel 12 can then be readily bent to form the bend 44 as desired. It is noted that after the form has been used in the configuration shown in FIG. 10, it can be restored to a straight shape by closing the cuts 46 and then heating the flanges 18 and 22 and the lips 20 and 24 to melt the plastic material in order to permanently close the cuts, thereby returning the form 10 to its normal straight condition.

In accordance with an additional aspect of the invention, form 10 is flexible both horizontally and vertically. Thus, the form is extremely useful for pouring concrete in a radius, pouring concrete on uneven grades, or both.

Figure 4:
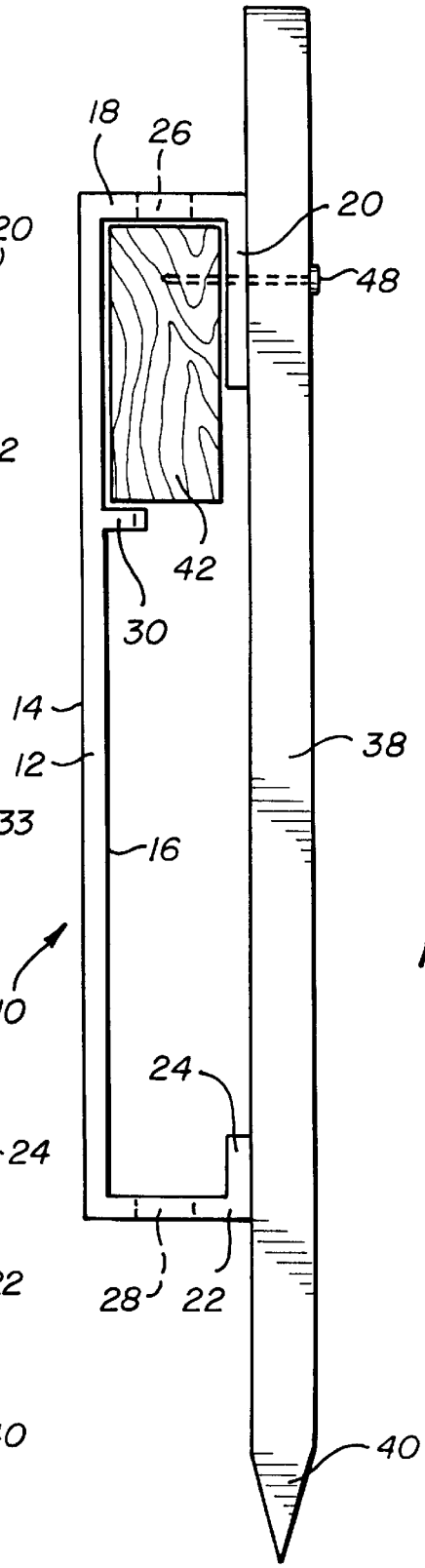
FIG. 4 is an end elevational view similar to FIG. 3, but showing the stake placed against the back lip on the upper flange of the form, driven into the ground, and secured by a fastener which is connected with the stake and which penetrates through the lip and into the core in order to secure the form and stake together.

FIG. 4 depicts an alternative arrangement for anchoring of the form 10. Rather than extending the stakes 38 through the openings 26 and 28 (and through the notches 36), each stake 38 is instead placed in a vertical position against the back surfaces of the lips 20 and 24 and then driven into the ground. A nail 48 or similar fastener can be fastened to the stake 38, as by extending it through a horizontal passage in the stake. The nail can be driven through the lip 20 and into the core member 42 which is located in front of the lip, thus securing the stake 38 to the form 10 and assuring that the form will be maintained in place when the concrete or other moldable material is poured. Using this type of anchoring arrangement, the stakes 38 can be placed as closely together as desired. It is also noted that the stake location shown in FIG. 4 can be used in addition to that shown in FIG. 3 to provide stakes that are located more closely together than is possible with the FIG. 3 arrangement alone. Alternatively, fasteners 48 may be placed through corresponding stakes 38 and directly into the core member 42, by inserting the fasteners 48 just below lip 20.

Figure 5:
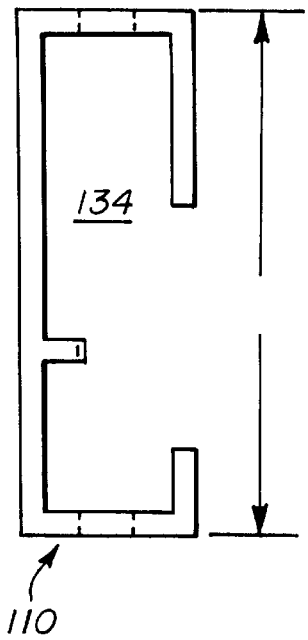
FIG. 5 is an end elevational view of a concrete form which is constructed in accordance with the present invention and which has a reduced height in comparison to the form shown in FIGS. 1–4.

FIG. 5 depicts an alternative form 110 which is identical to the form 10, except that the face panel 12 is shorter in the form 110. Form 110 provides a channel 134 that is identical to the channel 34 to permit the installation of core members such as the core members 42.

Figure 6:
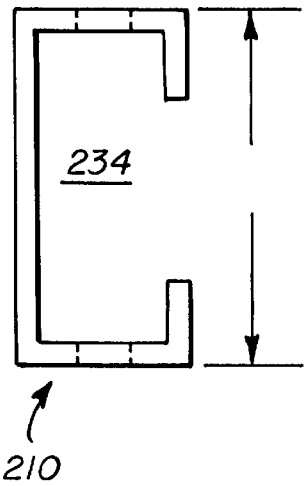
FIG. 6 is an end elevational view of a concrete form which is constructed according to still another embodiment of the invention and which is reduced in height compared to the form shown in FIG. 5.

The form 210 shown in FIG. 6 differs from form 110 in that form 210 has a reduced height such that a channel 234 for receiving core members 42 is presented between the upper and lower flanges 18 and 22. The rib 30 is eliminated from the form 210.

It is thus evident that the form of the present invention is well suited for use in the construction of both straight and curved structures, or a structure that has a combination of straight areas and curved areas. A single one of the forms can be used to provide both straight areas (with or without core members 42 installed) and curved areas (which are flexed into the desired curved shape without the core members 42 being installed in the curved portions of the form). Angular areas such as that provided by the bend 44 (FIG. 10) can easily be provided as well.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. An apparatus for forming poured concrete and other moldable material, comprising:

an elongate flexible form, wherein said form is constructed from a material in the group consisting of polyethylene, polyvinyl chloride, and polybutylene; and wherein said form has a face and a pair of spaced apart flanges presenting a channel therebetween; and wherein said form is adapted for flexure in a horizontal and a vertical direction;

a rigid core member having a size to fit in said channel and a substantially straight shape, said form being adapted for flexure into a curved shape with the channel vacant and for arrangement in a straight shape with the core member in the channel to rigidify the form;

a lip projecting downwardly from said upper flange to define a backside of said channel; and anchoring means for fixing said form to the ground.

2. The apparatus as set forth in claim 1, wherein said anchoring means for said straight shape comprises:

a plurality of stakes applicable to said lip and adapted to be driven into the ground; and a fastener for each stake connected with the stake and penetrating into said core member.

3. An apparatus for forming poured concrete and other moldable material, comprising:

an elongate flexible form, wherein said form is constructed from a material in the group consisting of polyethylene, polyvinyl chloride, and polybutylene, and wherein said form has a face and a pair of spaced apart flanges presenting a channel therebetween, and wherein said form is adapted for flexure in a horizontal and a vertical direction;

a rigid core member having a size to fit in said channel and a substantially straight shape, said form being adapted for flexure into a curved shape with the channel vacant and for arrangement in a straight shape with the core member in the channel to rigidify the form;

a rib projecting from said face at a location spaced above the lower flange and below the upper flange, said rib forming the bottom of said channel and presenting a ledge on which said core member rests when inserted in the channel; and anchoring means for fixing said form to the ground.

4. The apparatus as set forth in claim 3, including a plurality of ribs projecting from said face at respective locations spaced above the lower flange and below the upper flange, said ribs forming a plurality of channels, said apparatus further including a plurality of core members, each said core member being inserted in one of said channels.

5. The apparatus as set forth in claim 3, wherein said anchoring means comprises:

a plurality of holes in each flange, said holes being arranged in the upper and lower flanges in pairs and substantially vertically aligned; and a stake for each pair of holes extensible therethrough and into the ground.

6. The apparatus as set forth in claim 5, including a plurality of notches in said rib aligned with the holes in said pairs of holes and receiving the stakes.

7. Apparatus as set forth in claim 5, wherein said form is constructed from polyethylene.

8. Apparatus as set forth in claim 5, wherein said form is constructed from polyvinyl chloride.

9. Apparatus as set forth in claim 5, wherein said form is constructed from polybutylene.

10. An apparatus for forming poured concrete and other moldable material, comprising:

a form constructed of a flexible plastic material and having a face for contacting the moldable material, said face having upper and lower edges and upper and lower flanges extending therefrom;

a plurality of openings in each of said flanges arranged in pairs with an opening in the upper flange of each pair generally aligned vertically above an opening in the lower flange of the pair;

a ledge extending from said face at a location between the upper and lower flanges, said form presenting an open channel immediately above said ledge;

a rigid core member for insertion in said channel to rigidify said form; and a plurality of stakes applicable through said pairs of openings to anchor said form to the ground.

11. The apparatus as set forth in claim 10, wherein said ledge comprises a rib on the form defining the bottom of said channel, said core member resting on said rib when inserted in the channel.

12. An apparatus for forming poured concrete and other moldable material, comprising:

a form constructed of a flexible plastic material and having a face for contacting the moldable material, said face having upper and lower edges and upper and lower flanges extending therefrom;

means on said form for providing a ledge spaced between said flanges, said ledge cooperating with the upper flange to present a channel on the form;

a rigid core member in said channel for enhancing the rigidity of the form; and means for anchoring the form to the ground.

13. The apparatus as set forth in claim 12, wherein said anchoring means comprises:

a plurality of holes in each flange, said holes being arranged in the upper and lower flanges in pairs and substantially vertically aligned; and a stake for each pair of holes extensible therethrough and into the ground.

14. The apparatus as set forth in claim 12, including a lip projecting downwardly from said upper flange to define a back side of said channel, said anchoring means comprising:

a plurality of stakes applicable to said lip and adapted to be driven into the ground; and a fastener for each stake connected with the stake and penetrating through said lip and into said core member.

15. The apparatus as set forth in claim 12, wherein said form is constructed from a material in the group consisting of polyethylene, polyvinyl chloride, and polybutylene.

* * * * *